United States Patent [19]

Hine et al.

[11] Patent Number: 4,572,218

[45] Date of Patent: Feb. 25, 1986

[54] REMOISTENING OF TOBACCO

[75] Inventors: Edwin W. Hine, Philadelphia; Jack B. Rosenbloom, Elkins Park, both of Pa.

[73] Assignee: Proctor & Schwartz, Inc., Horsham, Pa.

[21] Appl. No.: 545,920

[22] Filed: Oct. 27, 1983

[51] Int. Cl.[4] ..... A24B 3/12

[52] U.S. Cl. ..... 131/302; 131/303; 131/304

[58] Field of Search ..... 131/290, 291, 296, 302–306

[56] References Cited

U.S. PATENT DOCUMENTS 4,091,824 5/1978 Psaras ..... 131/306
4,202,357 5/1980 de la Burde et al. ..... 131/903
4,336,660 6/1982 Strydom ..... 34/28
4,346,524 8/1982 Wochnowski et al. ..... 34/26

*Primary Examiner*—V. Millin
*Attorney, Agent, or Firm*—Richard H. Thomas

[57] ABSTRACT

A method and apparatus for reordering or remoistening tobacco wherein a circulating treating medium is passed through the tobacco bed. The apparatus is provided with both water and steam nozzles, and controls are provided such that the water input maintains a desired tobacco moisture level, whereas the steam input is controlled to keep the temperature of the circulating treating medium at a predetermined level. The water is in the form of an atomized fine mist at point of contact with the tobacco bed.

11 Claims, 5 Drawing Figures

CONTROL ALGORISM FOR HIGH PRESSURE MIST ORDERING SYSTEM

REMOISTENING OF TOBACCO

TECHNICAL FIELD

The present invention relates to the reordering or remoistening of tobacco, and specifically to a system of separate steam and water sprays responsive, respectively, to temperature and tobacco moisture measurements, to carry out the reordering or remoistening.

BACKGROUND ART

Traditionally, the tobacco industry has prepared tobacco for storage by overdrying, cooling, and reordering (remoistening) the tobacco on a continuous basis. The reordering, traditionally, is carried out by exposing the tobacco to steam introduced into a reordering chamber. There has been a reluctance to use water to avoid staining of the tobacco. The problem is that steam tends to not only increase moisture content but also tobacco temperature. The control for moisture content includes a moisture sensing device which senses tobacco moisture and, as the temperature increases the tobacco tends to dry more, so the sensor calls for more steam, establishing an upwardly directed temperature spiral. To prevent this, it is conventional to hold down temperature by introducing fresh air into the reordering chamber, responsive to a temperature measuring device measuring the tobacco temperature. The incoming fresh air is effective in holding down tobacco temperature, but it has the undesirable effect of wasting heat and energy, thereby reducing reorder efficiency.

A number of variations for conditioning tobacco have been disclosed in the prior art. One such apparatus is shown in Psaras U.S. Pat. No. 4,091,824. In the method and apparatus of this patent, the tobacco is conditioned by subjecting it to drying at first and second locations, to cooling at a third location, and to reordering at successive fourth and fifth locations, the fourth location employing downdraft and the fifth section updraft. In both the fourth and fifth sections, the reordering is carried out by a combination of steam and water. The patent is concerned primarily with apparatus for establishing laminar flow across the surface of a conveyor for the tobacco and details of control in the reordering sections are not disclosed. It is not indicated how either overheating or staining of the tobacco is avoided, if at all.

The Strydom U.S. Pat. No. 4,336,660 shows an apparatus for drying tobacco products such as cut rag, in which the same is subjected to moisturizing in a chamber upstream of the dryer and cooler. The purpose is to establish a constant temperature and moisture content prior to drying. In the upstream moisturizing section, both steam and water are employed, wherein the moisture is added in response to a moisture meter reading, and the temperature is kept constant in response to a temperature sensor by varying the ratio of steam and water used. Both the moisture and temperature sensors are upstream of the steam and water inputs, so that the control is feed-forward rather than feed-back. It is not indicated in the patent how staining of the tobacco is avoided, nor that this is even a problem in the method and apparatus of the patent.

In the method of the patent, a critical aspect is maintaining a constant mass flow rate. Thus, the method and apparatus of the patent would not be automatically responsive to changes such as change of grade of tobacco.

A similar disclosure is contained in U.S. Pat. No. 4,346,524, to Wochnowski et al, showing a moisturizing unit upstream of a dryer.

An object of the present invention is to control more efficiently the moisture content and temperature of a bed of tobacco, other objects being to avoid staining of the tobacco by water, and to provide an apparatus and method easily responsive to changes such as changes in tobacco mass flow rate, grade of tobacco, or kind of tobacco.

DISCLOSURE OF THE INVENTION

The present invention constitutes an improvement in the art, in a method for treating tobacco which comprises the steps of overdrying the tobacco in a drying chamber; passing said tobacco from said drying chamber to a cooling chamber, and then to successive reordering chambers; or alternatively, directly from said drying chamber to successive reordering chambers; omitting the cooling chamber; contacting said bed of tobacco in the reordering chambers with a treating medium in which is entrained an amount of atomized water, the amount of water being responsive to the moisture content of the bed of tobacco at a point adjacent the exit end of the reordering chambers; detecting the temperature of the tobacco in said reordering chambers; and contacting said bed of tobacco with a flow of steam independent of said amount of water and responsive to said temperature measurement.

In a preferred embodiment of the present invention, the water is introduced into the circulating treating medium at a point sufficiently removed from the bed of tobacco to obtain in the treatment medium substantially uniformly dispersed atomized water droplets by the time said medium contacts the tobacco bed. Preferably, the atomized water droplets have a maximum particle size less than about 100 microns, and an average particle size of about 50 microns.

The present invention also resides in improved apparatus for carrying out the method of the present invention.

BRIEF DESCRIPTION OF THE DRAWINGS

The invention will become more apparent upon consideration of the following specification, with reference to the accompanying drawings, in which.

BEST MODE FOR CARRYING OUT THE INVENTION AND INDUSTRIAL APPLICABILITY

Figure 1:
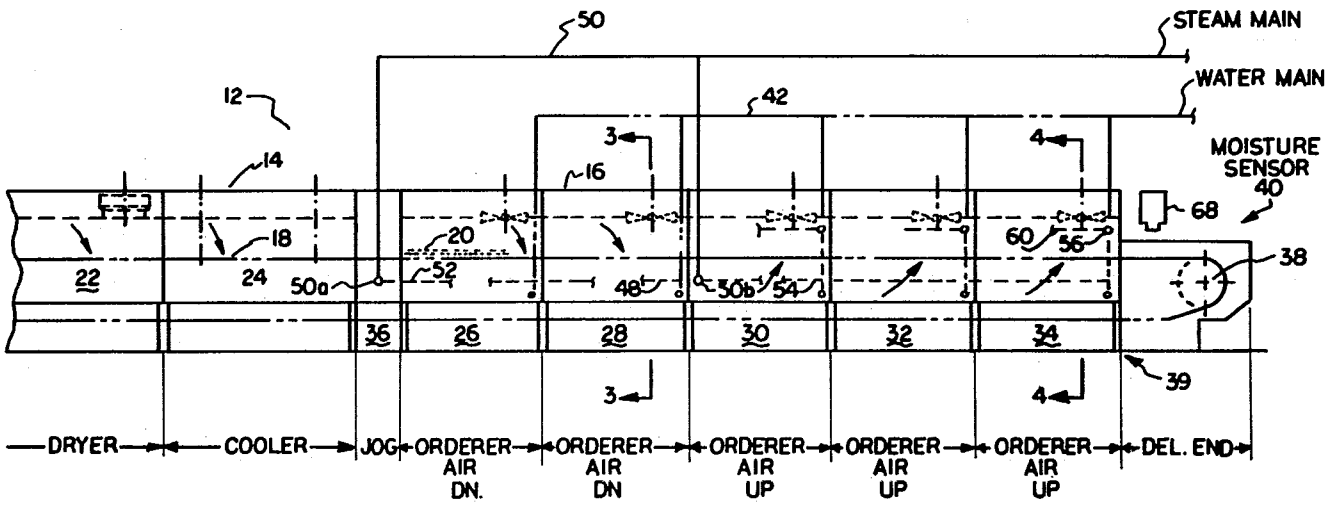
FIG. 1 is a side elevation, schematic, section view of a tobacco treatment apparatus in accordance with the concepts of the present invention.
Figure 2:
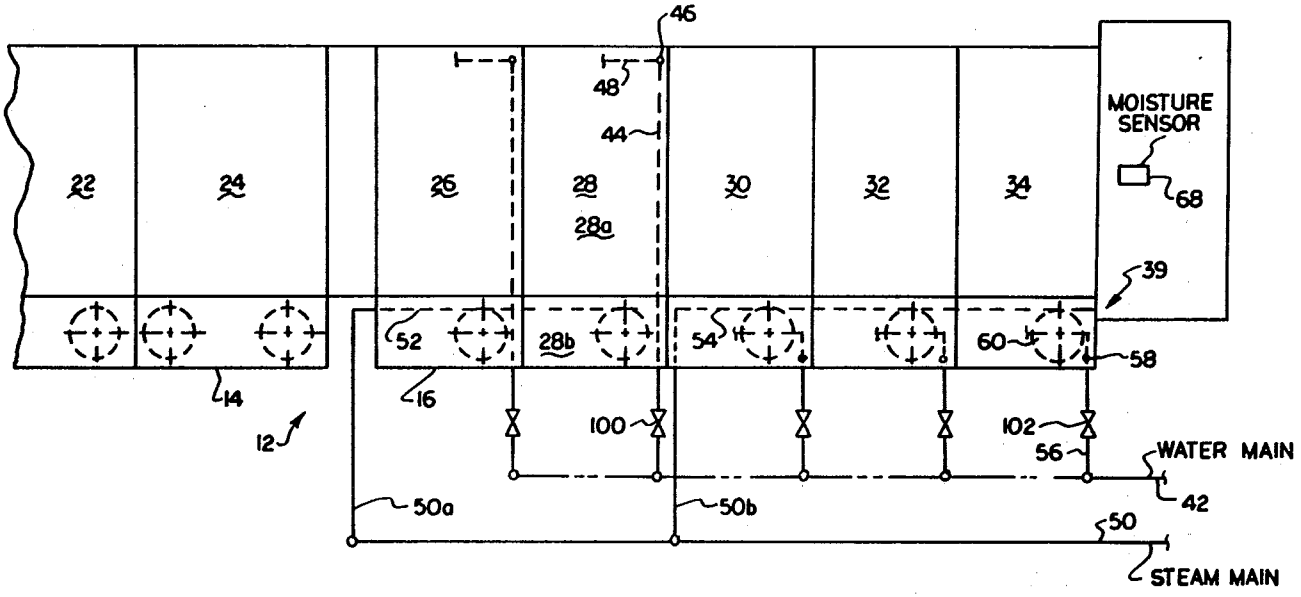
FIG. 2 is a plan view of the apparatus of FIG. 1.

With reference to the drawings, and in particular FIGS. 1 and 2, there is illustrated a tobacco dryer, cooler and reordering or moisturizing apparatus 12, including housings 14 and 16 through which a continuous belt conveyor 18 extends in a longitudinal direction. The conveyor 18, carrying a bed of tobacco 20, passes through a number of successive conditioning sections, traditionally a dryer section 22, followed by a cooling section 24, both in housing 14, and then successive reordering sections 26, 28, 30, 32 and 34.

In the drawings, the drying and cooling sections are separated from the successive reordering sections by a short space 36 marked with the lettering "JOG".

In practice, the drying, cooling and reordering sections are in long housings which are rectangular in cross section, having a single, long, conveyor (item 18) extending longitudinally through the housings and passing around sprockets at opposite ends of the housings. In the drawings, only sprocket 38 at the delivery or exit end 39 of the apparatus is illustrated.

In the apparatus of the present invention, the conveyor 18 is foraminous, so that a treating medium can pass through the conveyor and bed of tobacco on the conveyor. In this regard, the air flow, indicated by arrows in the respective sections, in FIG. 1, can be either in an upflow or downflow direction through the bed of tobacco and conveyor. In the embodiment illustrated, the air flow in the dryer section 22 is in a downward direction, as is the air flow in the cooler section 24. In the reordering sections, the air flow is in a downward direction in the first two sections 26 and 28, and then in an upward direction in the remaining sections 30, 32 and 34.

The reason for the air flow direction sequence is to minimize leakage between the different sections, as air changes tend to induce leakage. In the apparatus illustrated in FIG. 1, the dryer section 22 is actually preceded by a first dryer section not shown. The air flow in this first section is in an upward direction, which not only initiates drying, but tends to fluff the tobacco to enhance the treatment of the tobacco. To ensure uniform drying through the bed of tobacco, the direction of air flow in the second section 22 is in a downward direction. This dictates that the air flow direction in the cooler 24 also be in a downward direction to minimize leakage, and similarly, in a downward direction for the reordering sections 26 and 28. The upward direction of flow in the remaining reordering sections 30, 32 and 34 achieves optimum uniformity in treatment of the tobacco, with minimum leakage.

Figure 3:
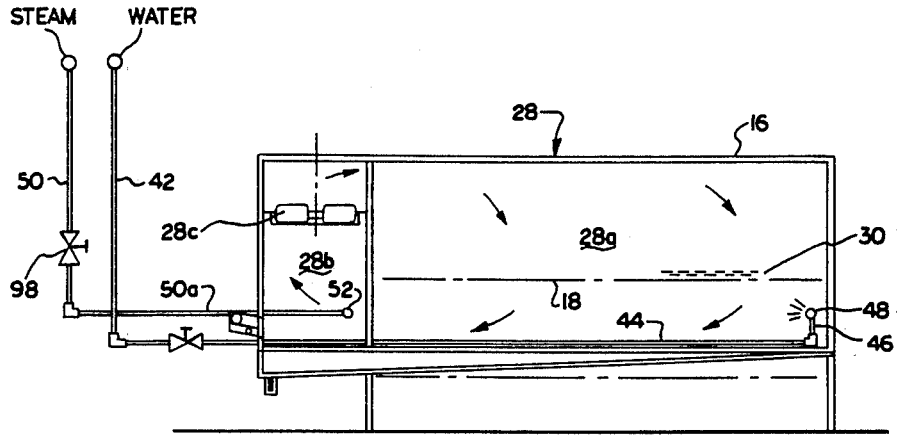
FIG. 3 is a slightly enlarged section view taken along line 3—3 of FIG. 1.
Figure 4:
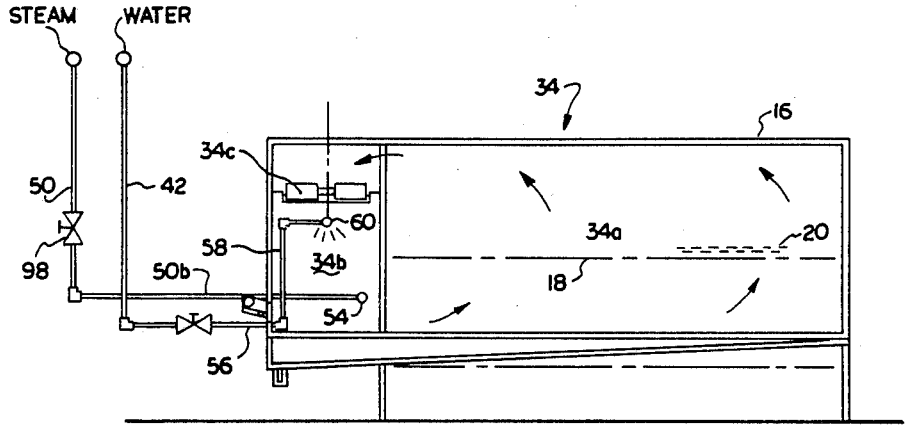
FIG. 4 is a slightly enlarged section view taken along line 4—4 of FIG. 1.

Referring to FIGS. 2, 3 and 4, the physical configuration of the reordering sections is shown. FIG. 3 is a cross section view of one of the downflow sections (section 28) and FIG. 4 is a cross section view of one of the upflow sections (section 34). In the section views of FIGS. 3 and 4, some of the piping for accuracy's sake could be in phantom lines, but for purposes of illustration has been shown in solid lines.

As illustrated in FIGS. 3 and 4, the reordering sections are generally similar in overall configuration to conventional drying and cooling sections of a conveyor dryer, comprising a generally rectangular housing 16, defining main plenum chambers **28*a* and 34*a* (FIGS. 3 and 4, respectively), through which the conveyor 18 extends, and to the left side of the main plenum chambers, recirculation chambers 28*b* and 34*b* for the recirculation of treating medium, induced by fan means 28*c* and 34*c*. In the reordering section of FIG. 3, the fan induces the medium flow in a downward direction through the bed of tobacco and conveyor, and in FIG. 4**, in an upflow direction through the bed of tobacco and conveyor.

Referring to FIGS. 3 and 4, water is supplied to the reordering sections by water main 42, and steam by a steam main 50. In the downflow system of FIG. 3, the water main 42 connects with a header 48 by means of connecting piping 44 and 46. Referring to FIGS. 2 and 3, it can be seen that the header 48 extends in a horizontal, longitudinal direction beneath the conveyor 18 and is positioned in a corner of the housing 16 almost diametrically opposed to the corner of the housing which accommodates fan **28*c*. The header 48 is provided with a plurality of atomizing nozzles (not shown) on the inboard side of the header, through which water is sprayed or atomized into the treating medium immediately after it passes through the bed of tobacco 20 and conveyor 18**, as shown.

The steam main 42, in the downflow section 28, is connected with a header 52 via piping **50*a*. As shown in FIG. 2, the header 52 extends in a horizontal longitudinal direction in the recirculation chamber 28*b* (FIG. 3) underneath the fan 28*c*, and generally in the main stream of the treating medium. The header 52 is provided with a plurality of openings, on the top side of the header, to inject steam into the treating medium before it passes through the fan 28*c***.

It was found, in accordance with the concepts of the present invention, that by positioning the water header 48 in the location shown, staining of the tobacco by water could be avoided. The treating medium passes all the way through the recirculation section, the circulating fan, and into the plenum chamber above the tobacco bed before contacting the tobacco bed. This allows the water atomized into the treating medium to become uniformly dispersed in the medium before contacting the bed of tobacco. Any large droplets of water that are formed are ejected from the treating medium by the multiple turns it makes before contacting the tobacco bed.

In the upflow section 34, the water main 42 connects with a longitudinally extending horizontal header 60 via piping 56 and 58 (FIGS. 2 and 4). The header 60, as illustrated in FIG. 4, is positioned immediately beneath the fan **34*c*, in the stream of treating medium immediately after it passes through the fan. The nozzle openings, which are the same as in water headers 48 in the downflow ordering sections, are oriented to disperse the water downwardly in the same direction as the flow of the treating medium. The steam main 50 is connected to a single continuous longitudinal, horizontal header 54 (FIGS. 2 and 4) positioned in the recirculating section in the same location as in the downflow sections 26 and 28**.

By positioning the water header 60 in the location shown in FIG. 4, the distance between the header and the bed of tobacco is maximized, again to avoid staining of the tobacco. In addition, the treating medium takes a plurality of turns, as indicated, for throwout of large water particles.

The dimensions for the steam and water headers, number of nozzles and nozzle sizes, are important towards optimizing operation of the apparatus of the present invention. By way of example, in an 8-foot long chamber, the water headers 48 and 60 may be about 3 feet in length. The portions of the steam headers 52 and 54 which contain nozzle openings for emission of steam may also be about 3 feet in length in each chamber. In both the steam and water headers, there may be employed about 4–5 nozzles or openings per 3 foot section. For the water atomization, any number of commercially available spray nozzles may be used. One suitable such nozzle is Model No. 1/4 LNN marketed by Spraying Systems Company, having a nozzle opening 0.2" in diameter. At a water pressure of 200 to 1000 psi, these are capable of producing atomized water about 50 microns average particle size, with a maximum particle size of less than 100 microns. In the steam headers, simple openings about 0.125" to 0.250" in diameter suffice.

It should be understood that the arrangement of headers and piping in the sections 30 and 32 generally duplicate that in section 34. Similarly, the arrangement in section 26 duplicates that in section 28. In this regard, referring to FIG. 2, only a single, long steam header 54 is employed for all of the sections 30, 32 and 34, and the openings for emission of steam are located in separate 3-foot sections of the header at spaced intervals along the header, the sections being more or less centered in the respective chambers. Similarly, only a single steam header 52 serves both sections 26 and 28 by means of two separate and centered 3-foot sections which are perforated for emission of steam. The dimension of 3 feet was found to be optimum for chambers about 8 feet in length and this specific dimension can vary, depending upon other dimensions, conditions, a material being treated.

Figure 5:
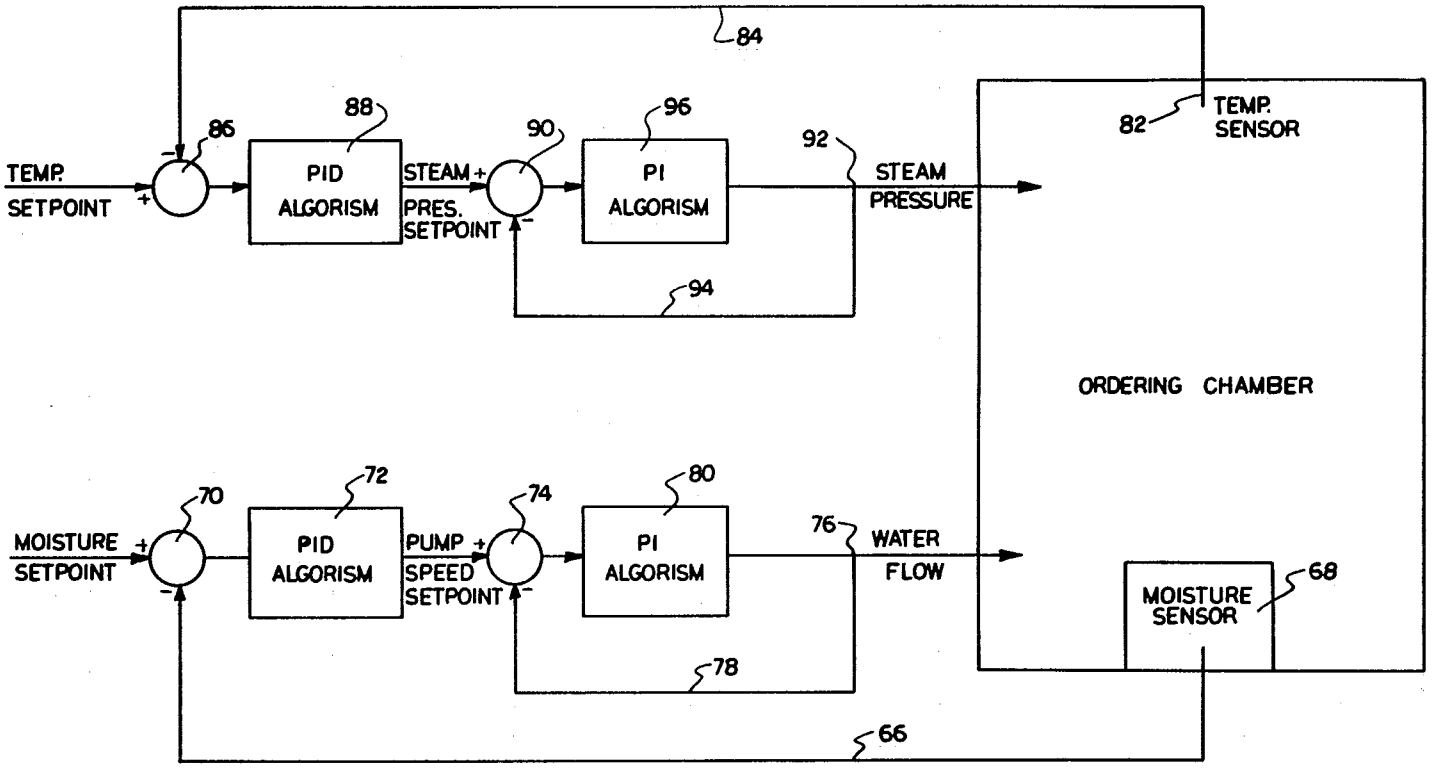
FIG. 5 is a schematic drawing showing controls for the apparatus of the present invention.

The flow of water into the water main 42 and then headers 48 and 54 is by a means of a positive displacement pump (not shown) driven by a variable speed drive in a conventional manner. The speed at which the pump is driven is controlled by a control system illustrated in FIG. 5, in which a moisture signal is transmitted from a moisture sensor 68 in an outer control loop 66, to a summer 70 which generates a moisture error signal. This signal is transmitted to a 3-mode moisture controller 72, designated a PID algorism. This is a conventional designation for a 3-mode controller, the letters PID standing for proportional control, integral control, and derivative control. Its output is proportional to error (proportional control), and proportional to time integrated with error in the sense that the longer the error, the more the output increases (integral control). The derivative control output is, in a sense, an anticipation of what is about to occur, functioning to somewhat dampen the output. The combined output provides a pump speed set point which is transmitted to summer 74. The summer 74 also receives a speed signal from pump speed sensor 76, via inner loop 78, and generates a speed error signal which is transmitted to a 2-mode speed controller 80, designated PI Algorism, which controls actual speed of the positive displacement pump.

An aspect of the present invention is positioning the moisture sensor 68 at the output or discharge end of the apparatus, as illustrated in FIGS. 1 and 2. This means that the measurement is of the actual tobacco moisture, and whatever corrective action is required it is taken to keep this at a desired level by addition of atomized water.

The steam control is similar to the water control, employing a signal from temperature sensing means 82 via an outer loop 84 to a summer 86. The latter receives a temperature set point signal and generates a temperature error signal which is transmitted to a PID Algorism 88. The Algorism 88 provides a steam pressure set point output. This is transmitted to summer 90, which also receives a steam pressure signal from pressure sensing means 92, via inner loop 94, and generates steam pressure error signal.

The steam pressure error signal is transmitted to a PI Algorism 96, which provides an output signal actuating a pressure control valve 98 (FIGS. 3 and 4) in the steam main 50.

The temperature sensing means is normally in the form of a number of temperature sensors such as thermocouples or resistance temperature detectors in the circulating air stream in a plurality of the reordering chambers, with the multiple signals being averaged and compared with the temperature set point signal in the temperature controller.

If desired, additional controls can be employed. For instance, the feedback control illustrated can be integrated with a feed forward control for even further refined control.

In addition to water volume control, achieved by adjusting pump speed, an operator, in the apparatus of the present invention, has the option of being able to select the number of active nozzles in the air-down and air-up compartments by manually turning nozzle banks on or off with valves 100 and 102 positioned in the lines 44 and 56 between the water main 42 and water headers 48 and 60.

As the water volume is changed, water pressure will vary at a non-linear rate, between about 200 and about 1000 lbs./sq. inch, but the water droplet size changes very little when the equipment is operated within normal volume limits. However, actual nozzle pressure depends upon the number of active atomizing nozzles at a specific pump volume, and if the water volume is outside of its normal operating range, the number of active nozzles may be selected to adjust the pressure within the above limits.

Below is an example of the ability of the present invention to automatically adapt to changes in tobacco flow rate without manual opening or closing of the valves 100 and 102.

EXAMPLE

In a typical reordering section, 20,000 lb./hr. bone dry basis tobacco can be reordered from a moisture of 9% WWB (9.9% bone dry basis) to 13.5% WWB (15.6% bone dry basis). Below is a chart of moisture requirements assuming heat losses of 300,000 BTU/hr. from heat conduction through walls.

| Tobacco Flow Rate | Steam Flow Rate | Water Flow Rate | |
|---|---|---|---|
| lb./hr. (BDB) | lb./hr. | lb./hr. | GPH |
| 20,000 | 174 | 966 | 117 |
| 15,000 | 109 | 746 | 90 |
| 10,000 | 58.7 | 511 | 61.7 |
| 5,000 | 22.2 | 263 | 31.7 |

The apparatus of this example has 9 headers capable of 15 GPH each. Below is a chart of the resulting header pressure (PSI) using different numbers of headers.

| Tobacco Flow Rate | Number of Headers in Use | | | | | |
|---|---|---|---|---|---|---|
| lb./hr. BDB | 9 | 8 | 7 | 6 | 5 | 4 |
| 20,000 | 750 | 950 | — | — | — | — |
| 15,000 | 444 | 562 | 734 | 1000 | — | — |
| 10,000 | 209 | 264 | 345 | 470 | 676 | — |
| 5,000 | — | — | — | 124 | 179 | 219 |

Pressures below 100 PSI result in water drops too large and not acceptable. Pressures above 1000 PSI require the use of unduly expensive equipment. From the above, it is apparent that only at a tobacco flow rate of 5,000 lb./hr. or less is it necessary to resort to manual adjustment. At all other flow rates, the control is automatically responsive to such changes as flow rate change, or change in grade or kind of tobacco.

Advantages of the present invention should be apparent. Principally, the present invention permits maintaining a desired moisture content of a bed of tobacco and its temperature level, at the discharge end of the reordering apparatus, without exhausting recirculating medium and drawing in fresh air. This substantially increases efficiency in the reordering process. In addition, the reordering is carried out without the problem of tobacco staining. Some of the droplets of water will be flashed into steam and the remainder atomized and uniformly dispersed in the treating medium prior to contact with the bed of tobacco. Large droplets are thrown out of the flow stream of the treating medium.

Still further, the present invention has substantial flexibility, providing a system which is readily and automatically operable with different grades of tobacco, different types of tobacco (including leaves and stems) and different flow rates, on a continuous basis.

Although the invention has been described with respect to tobacco, it will be apparent to those skilled in the art that it has other applications, for instance, controlled moisturization of synthetic and natural fibers, chemicals, and foods.

We claim:

1. A method for reordering tobacco comprising the steps of:

(a) overdrying said tobacco in a drying chamber;
(b) passing said tobacco from said drying chamber to at least one reordering chamber for moisture treatment therein;
(c) contacting said bed of tobacco with a treating medium in said reordering chamber;
(d) detecting the temperature of said tobacco in said reordering chamber;
(e) maintaining the temperature of the treating medium at a predetermined level by introducing steam into the treating medium at a rate responsive to the temperature detected;
(f) introducing an amount of finely atomized water into said treating medium;
(g) measuring the moisture content of the bed of tobacco at a point adjacent the outlet of said reordering chamber; and
(h) controlling said amount of atomized water in response to the moisture measurement.

2. The method of claim 1 wherein the controls of steps (e) and (h) are feedback controls.

3. The method of claim 1 wherein the moisture contacting the bed of tobacco has an average particle size of about 50 microns and a maximum particle size less than about 100 microns.

4. The method of claim 3 wherein said treating medium containing atomized water is air recirculated in the reordering chamber and passing through the bed of tobacco, the water being introduced into the air in such a way as to be thoroughly dispersed in the air at the point of passage through the bed of tobacco.

5. The method of claim 4 including successive reordering steps, the treating medium being in an upflow direction in at least one of said reordering steps, and in a downflow direction in at least one other of said reordering steps.

6. A tobacco reordering apparatus comprising (a) a chamber having an inlet and exit end;
(b) foraminous conveyor means extending longitudinally within said chamber between said inlet and exit ends, adapted to move a bed of tobacco through the chamber;
(c) circulation means adapted to circulate a treating medium through said conveyor means;
(d) water spray means adapted to introduce into said treating medium a fine spray of water droplets;
(e) steam spray means adapted to introduce into said treating medium a flow of steam;
(f) moisture measuring means contiguous with said chamber exhaust end adapted to measure the moisture level of said bed of tobacco and to produce a moisture signal;
(g) temperature measuring means in said chamber adapted to measure the temperature of said bed of tobacco in said chamber and to produce a temperature signal;
(h) water control means responsive to said moisture signal adapted to control the rate of water flow; and
(i) steam control means responsive to said temperature signal means adapted to control the rate of steam flow.

7. The apparatus of claim 6 wherein said chamber comprises a treating chamber through which said conveyor means extends, and a recirculation chamber adapted to recirculate the treating medium through said treating chamber, said water spray means being positioned in the flow path of the treating medium at a point of approximate maximum remoteness from the point of passage of treating medium from the recirculation chamber into the treating chamber.

8. The apparatus of claim 7 wherein the direction of flow of treating medium in the treating chamber is downward through the bed of tobacco, the water spray means being positioned immediately beneath the conveyor means.

9. The apparatus of claim 7 adapted to direct the treating medium downstream of the water spray means through a tortuous path to remove large water droplets.

10. The apparatus of claim 6 adapted to uniformly disperse the water droplets in the treating medium prior to contact with the bed of tobacco.

11. A method for moisturizing materials which comprises the steps of (a) overdrying said materials in a drying chamber;
(b) passing said materials from said drying chamber to successive remoisturizing chambers;
(c) contacting said materials with a treating medium in which is entrained an amount of atomized water, the amount of water being responsive to the moisture content of said material at a point adjacent the exit end of the moisturizing chambers;
(d) detecting the temperature of said materials in said moisturizing chambers; and
(e) contacting said materials with a flow of steam independent of said amount of water and responsive to said temperature measurement.

* * * * *